US011681249B2

(12) United States Patent
Yokoyama

(10) Patent No.: US 11,681,249 B2
(45) **Date of Patent: *Jun. 20, 2023**

(54) HEATING DEVICE AND HEAT GENERATING MEMBER

(71) Applicant: TOSHIBA TEC KABUSHIKI KAISHA, Tokyo (JP)

(72) Inventor: Shuji Yokoyama, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/688,956

(22) Filed: Mar. 8, 2022

(65) Prior Publication Data

US 2022/0197202 A1 Jun. 23, 2022

Related U.S. Application Data

(63) Continuation of application No. 17/337,483, filed on Jun. 3, 2021, now Pat. No. 11,300,909.

(30) Foreign Application Priority Data

Sep. 18, 2020 (JP) ..... JP2020-157077

(51) Int. Cl.
*G03G 15/20* (2006.01)

(52) U.S. Cl.
CPC ..... *G03G 15/2057* (2013.01); *G03G 15/2053* (2013.01)

(58) Field of Classification Search
CPC ..... G03G 15/2053; G03G 15/2057
See application file for complete search history.

(56) References Cited

U.S. PATENT DOCUMENTS

| | | | | |
|---|---|---|---|---|
| 11,300,909 | B1 * | 4/2022 | Yokoyama | G03G 15/2057 |
| 2006/0182474 | A1 | 8/2006 | Naito et al. | |
| 2011/0135359 | A1 | 6/2011 | Kikuchi et al. | |
| 2011/0217097 | A1 | 9/2011 | Nanjo | |
| 2016/0357134 | A1 | 12/2016 | Kikuchi | |
| 2017/0139356 | A1 | 5/2017 | Yokoyama | |

FOREIGN PATENT DOCUMENTS

JP 2010-002797 1/2010

* cited by examiner

*Primary Examiner* — Sandra Brase
(74) *Attorney, Agent, or Firm* — Amin, Turocy & Watson, LLP

(57) ABSTRACT

According to one embodiment, a heating device includes a belt and a contact member. The belt has a tubular shape. The contact member is provided inside the belt. The contact member is formed in an arc shape along the inner peripheral surface of the belt. The contact member is slidably in contact with the inner peripheral surface of the belt. When the amount of deflection of the belt is D, the radius of curvature of the inner peripheral surface of the belt is A, and the radius of curvature of the outer peripheral surface of the contact member is B, the following equations (1) and (2) are satisfied:

$$D \geq 10 \text{ mm} \quad (1)$$

$$0.4 \text{ mm} \geq A - B \geq 0 \text{ mm} \quad (2).$$

20 Claims, 6 Drawing Sheets

FIG. 4
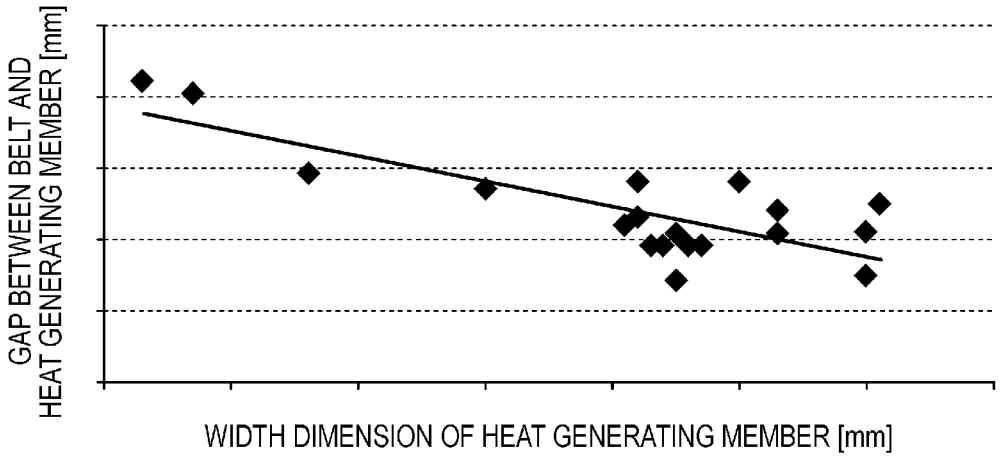
FIG. 5
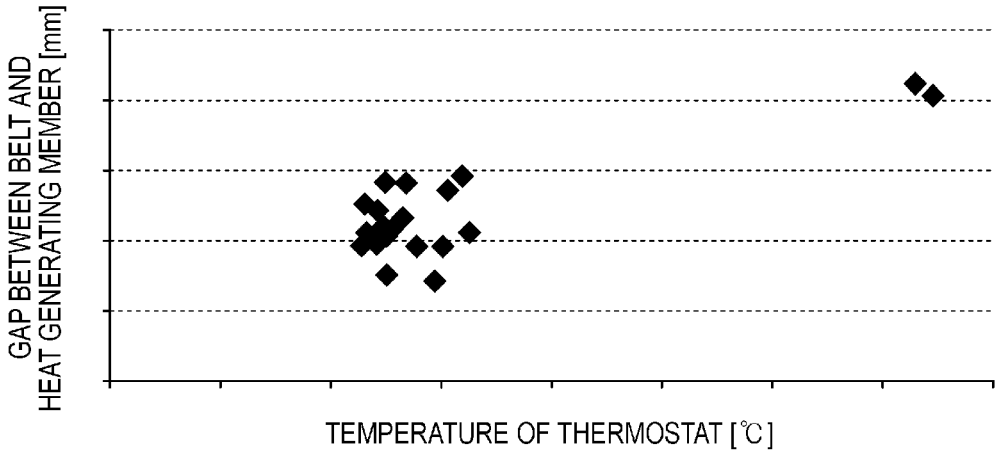
FIG. 6
| DIFFERENCE BETWEEN INNER DIAMETER OF BELT AND OUTER DIAMETER OF HEAT GENERATING MEMBER [mm] | ADHESION BETWEEN BELT AND HEAT GENERATING MEMBER |
|---|---|
| 0. 8 | △ |
| 0. 7 | ○ |
| 0. 6 | ○ |

UNIT: mm

| INNER DIAMETER 30 | Le | Re |
|---|---|---|
| 1 | 6.6 | 6 |
| 2 | 5.9 | 6.2 |
| 3 | 5.9 | 6.7 |
| 4 | 6.3 | 5.8 |
| 5 | 5.8 | 6.4 |
| 6 | 6.1 | 6.3 |
| Max | | 6.7 |
| Min | | 5.8 |
| Ave | | 6.2 |

FIG. 10

UNIT: mm

| INNER DIAMETER 40 | Le | Re |
|---|---|---|
| 1 | 14 | 13.8 |
| 2 | 14.4 | 13.3 |
| 3 | 14.6 | 13.7 |
| 4 | 15.2 | 15.6 |
| 5 | 14.7 | 14.4 |
| 6 | 14.9 | 14.5 |
| Max | | 15.6 |
| Min | | 13.3 |
| Ave | | 14.4 |

HEATING DEVICE AND HEAT GENERATING MEMBER

CROSS-REFERENCE TO RELATED APPLICATIONS

This application is a Continuation of application Ser. No. 17/337,483 filed on Jun. 3, 2021, the entire contents of which are incorporated herein by reference.

This application is based upon and claims the benefit of priority from. Japanese Patent Application No. 2020-157077, filed on Sep. 18, 2020, the entire contents of which are incorporated herein by reference.

FIELD

Embodiments described herein relate generally to a heating device and an image processing device.

BACKGROUND

An image processing device includes a heating device that fixes toner (recording agent) to the sheet by the heat of the belt. The heating device heats the belt with an electromagnetic induction heating method. The heating device includes a heat generating member in contact with the inner peripheral surface of the belt to make up for the lack of heating value of the belt. The heat generating member is formed in an arc shape along the inner peripheral surface of the belt. Depending on the variation in the dimensions of the heat generating member, the belt and the heat generating member may not be sufficiently adhered to each other, the heat transport between the heat generating member and the belt may not be sufficiently performed, and the temperature of the heat generating member may rise excessively.

DESCRIPTION OF THE DRAWINGS

FIG. 4 is a diagram showing the relationship between the width dimension of the heat generating member and the gap between the belt and the heat generating member;

FIG. 5 is a diagram showing the relationship between the gap between the belt and the heat generating member and the temperature of the thermostat;

FIG. 6 is a diagram showing the relationship between the difference between the inner diameter of the belt and the outer diameter of the heat generating member and the adhesion between the belt and the heat generating member;

FIG. 10 is a diagram showing a measurement result of the amount of deflection of a belt having an inner diameter of 40 mm.

DETAILED DESCRIPTION

Figure 1:
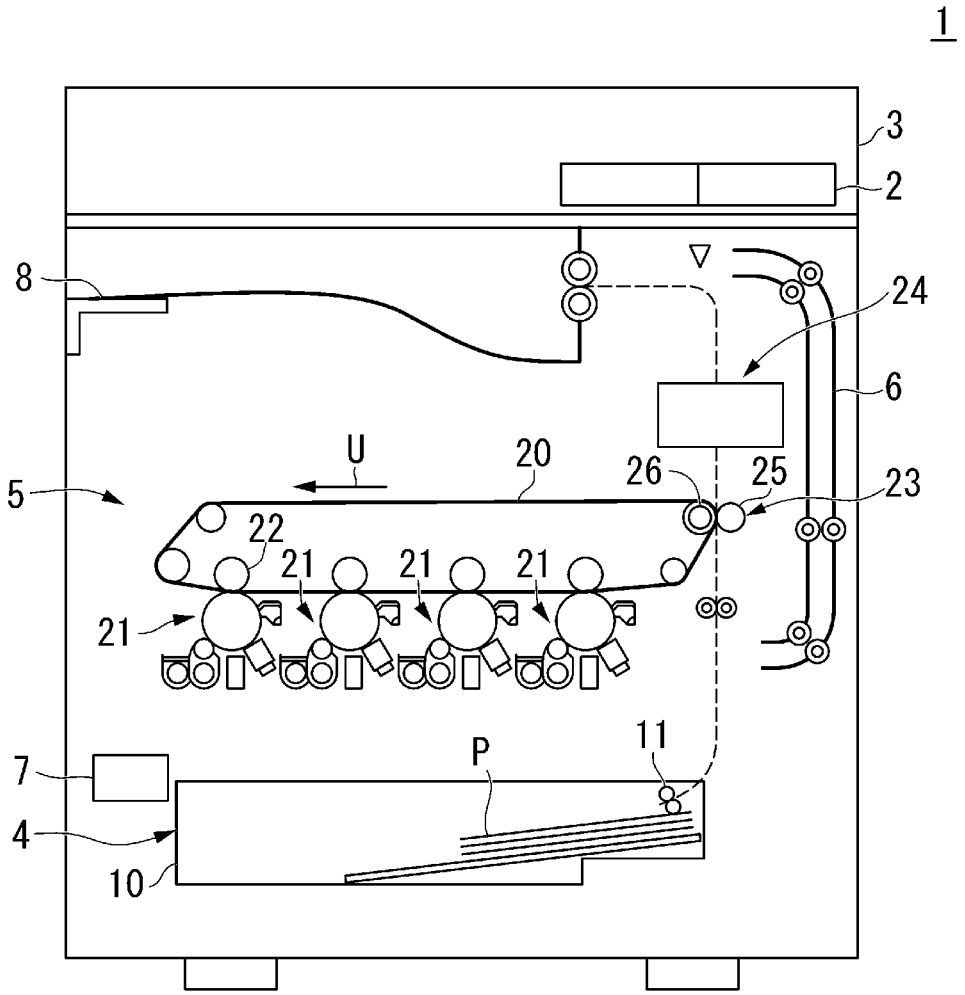
FIG. 1 is a schematic diagram of an image processing device according to an embodiment.

One aspect of the present disclosure is to provide a heating device and an image processing device capable of suppressing an excessive temperature rise of a heat generating member.

In general, according to one embodiment, the heating device includes a belt and a heat generating member. The belt has a tubular shape. The heat generating member is provided inside the belt. The heat generating member is formed in an arc shape along the inner peripheral surface of the belt. The heat generating member is slidably in contact with the inner peripheral surface of the belt. When the amount of deflection of the belt is D, the radius of curvature of the inner peripheral surface of the belt is A, and the radius of curvature of the outer peripheral surface of the heat generating member is B, the following equations (1) and (2) are satisfied.

$$D \geq 10 \text{ mm} \quad (1)$$

$$0.4 \text{ mm} \geq A - B \geq 0 \text{ mm} \quad (2)$$

Hereinafter, the heating device and the image processing device of the embodiment will be described with reference to the drawings.

FIG. 1 is a schematic diagram of an image processing device 1 according to a first embodiment.

For example, an image processing device 1 is a multi-function peripheral (MFP). The image processing device 1 reads an image formed on a sheet-shaped recording medium (hereinafter referred to as "sheet") such as paper to generate digital data (image file). The image processing device 1 forms an image on a sheet using toner based on digital data.

The image processing device 1 includes a display unit 2, an image reading unit 3, a sheet supply unit 4, an image forming unit 5, a sheet reversing unit 6, and a control unit 7.

The display unit 2 operates as an output interface and displays characters and images. The display unit 2 also operates as an input interface and receives instructions from the user. For example, the display unit 2 is a touch panel type liquid crystal display.

For example, the image reading unit 3 is a color scanner. Examples of the color scanner include a contact image sensor (CIS) and charge coupled devices (CCD). The image reading unit 3 uses a sensor to read an image formed on the sheet and generates digital data.

The sheet supply unit 4 supplies the sheet used for image output to the image forming unit 5. The sheet supply unit 4 includes a sheet feed cassette 10 and a pickup roller 11. The sheet feed cassette 10 stores the sheet P. The pickup roller 11 picks up the sheet P from the sheet feed cassette 10.

The image forming unit 5 forms an image on the sheet using toner. The image forming unit 5 forms an image based on the image data read by the image reading unit 3 or the image data received from an external device. For example, the image formed on the sheet is an output image called a hard copy, a printout, or the like.

The image forming unit 5 includes an intermediate transfer body 20, an image forming unit 21, a primary transfer roller 22, a secondary transfer unit 23, and a heating device 24.

The transfer in the image forming unit 5 includes a first transfer step and a second transfer step. In the first transfer process, the primary transfer roller 22 transfers the image (toner image) of the toner on the photoconductor drum of each image forming unit 21 to the intermediate transfer body 20. In the second transfer process, the secondary transfer unit 23 transfers the image to the sheet with the toner of each color laminated on the intermediate transfer body 20.

The intermediate transfer body 20 is an endless belt. The intermediate transfer member 20 is rotating in the direction of arrow U in FIG. 1. A toner image is formed on the surface of the intermediate transfer body 20.

The image forming unit 21 forms an image using toner of each color (for example, 5 colors). A plurality of image forming units 21 are installed along the intermediate transfer body 20.

The primary transfer roller 22 transfers the toner image formed by the image forming unit 21 to the intermediate transfer body 20.

The secondary transfer unit 23 includes a secondary transfer roller 25 and a secondary transfer counter roller 26. The secondary transfer unit 23 transfers the toner image formed on the intermediate transfer body 20 to the sheet.

The heating device 24 fixes the toner image transferred on the sheet to the sheet by heating and pressurizing. The sheet on which the image was formed by the heating device 24 is discharged from a sheet discharge unit 8 to the outside of the device.

The sheet reversing unit 6 is arranged on the side of the heating device 24. The sheet reversing unit 6 reverses the front and back of the sheet. For example, the front and back reversing of the sheet is performed if forming an image on both the front and back surfaces of the sheet.

The control unit 7 controls each component of the image processing device 1.

Next, the heating device 24 will be described.

Figure 2:
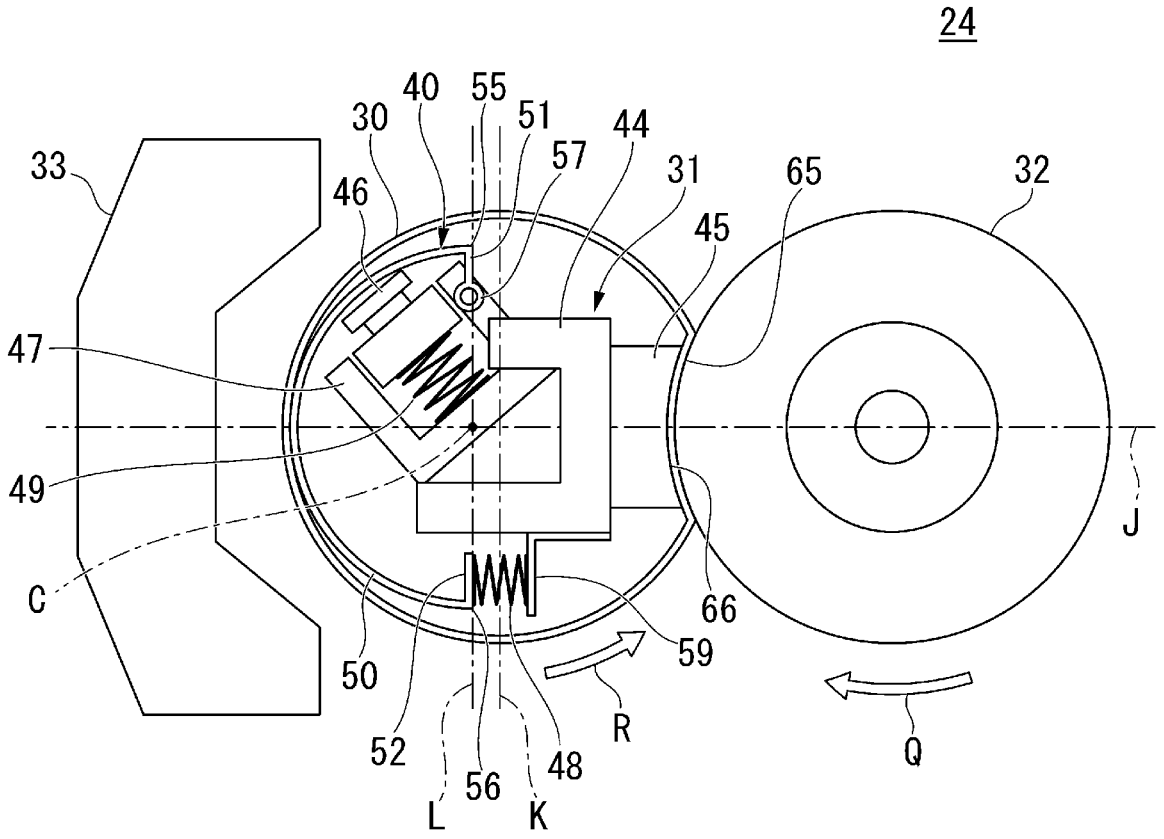
FIG. 2 is a schematic diagram of a heating device.

FIG. 2 is a schematic diagram of the heating device 24 of the embodiment.

As shown in FIG. 2, the heating device 24 includes a belt 30, a belt internal mechanism 31, a press roller 32, and an induced current generating unit 33.

The belt 30 is a tubular endless belt. For example, the inner diameter of the belt 30 is set to a size of 35 mm or more and 50 mm or less. For example, the belt 30 is formed by sequentially laminating a heat generating layer (conductive layer), which is a heat generating unit, and a release layer on a base layer. For example, the base layer is formed of a polyimide resin (PI). For example, the heat generating layer is formed of a non-magnetic metal such as copper (Cu). For example, the release layer is formed of a fluororesin such as a tetrafluoroethylene/perfluoroalkyl vinyl ether copolymer resin (PFA). The layer structure of the belt 30 is not limited as long as a heat generating layer is included.

The belt internal mechanism 31 is arranged inside the belt 30. The belt internal mechanism 31 includes a heat generating member 40, a frame 44, a nip pad 45, a thermostat 46, a holder 47, a first biasing member 48, and a second biasing member 49.

The heat generating member 40 is in contact with the inner peripheral surface of the belt 30. The heat generating member 40 faces the induced current generating unit 33 with the belt 30 interposed therebetween. The heat generating member 40 is made of a magnetic material. For example, the heat generating member 40 is formed of a magnetic shunt alloy having a Curie point lower than that of the heat generating layer. For example, the heat generating member 40 is formed of a thin metal member made of a magnetic shunt alloy such as iron or nickel alloy having a Curie point of 220° C. to 230° C.

The heat generating member 40 may be formed of a thin metal member having magnetic properties, such as iron, nickel, and stainless steel. The heat generating member 40 may be formed of a resin or the like containing magnetic powder as long as it has magnetic properties. The heat generating member 40 may be formed of a magnetic material (ferrite).

The heat generating member 40 has a length in the axial direction of the belt 30 (hereinafter referred to as "belt axial direction"). The heat generating member 40 is curved along the inner peripheral surface of the belt 30. The heat generating member 40 is slidably in contact with the inner peripheral surface of the belt 30. The heat generating member 40 includes a curved portion 50, a first bent portion 51, and a second bent portion 52. The curved portion 50, the first bent portion 51, and the second bent portion 52 are integrally formed of the same member.

The curved portion 50 is formed in an arc shape along the inner peripheral surface of the belt 30. The curved portion 50 is in contact with the inner peripheral surface of the belt 30. The radius of curvature of the curved portion 50 is smaller than the radius of curvature of the belt 30. The outer peripheral surface of the curved portion 50 may be plated or coated with chromium nitride, diamond-like carbon (DLC), and the like. By plating or coating with chromium nitride, DLC, and the like, the slidability between the curved portion 50 and the belt 30 is improved.

The first bent portion 51 is bent inward from a first end portion 55 in the circumferential direction of the curved portion 50. A plurality of first bent portions 51 are provided in the belt axial direction. The first bent portion 51 includes an annular portion 57 that is annular. The annular portion 57 is supported by a swing shaft (not shown) along the belt axial direction. The heat generating member 40 can swing around the swing shaft.

The second bent portion 52 is bent inward from a second end portion 56 in the circumferential direction of the curved portion 50. A plurality of second bent portions 52 are provided in the belt axial direction. The second bent portion 52 is connected to a first end portion of the first biasing member 48. For example, the first biasing member 48 is an elastic member such as a compression spring. A second end portion of the first biasing member 48 is connected to a stay 59. The stay 59 is fixed to the frame 44. The heat generating member 40 is pressed against the belt 30 by the first biasing member 48.

The nip pad 45 presses the belt 30 against the press roller 32. The nip pad 45 is fixed to the frame 44. The nip pad 45 forms a nip 65 between the belt 30 and the press roller 32. The nip pad 45 has a nip forming surface 66 that forms the nip 65. The nip forming surface 66 is curved toward the inside of the belt 30 when viewed from the belt axial direction. The nip forming surface 66 is curved along the outer peripheral surface of the press roller 32 when viewed from the belt axial direction.

For example, the nip pad 45 is formed of an elastic material such as silicone rubber and fluororubber. The nip pad 45 may be formed of a heat-resistant resin such as a polyimide resin (PI), a polyphenylene sulfide resin (PPS), a polyether sulfone resin (PES), a liquid crystal polymer (LCP), or a phenol resin (PF).

For example, a sheet-shaped friction reducing member (not shown) is arranged between the belt 30 and the nip pad 45. For example, the friction reducing member is formed of a sheet member having good slidability and excellent wear resistance, a release layer, and the like. The friction reducing member is fixedly supported by the belt internal mechanism 31. The friction reducing member is in sliding contact with the inner peripheral surface of the traveling belt 30. The friction reducing member may be formed of the following sheet members having lubricity. For example, the sheet member may be made of a glass fiber sheet impregnated with a fluororesin. For example, the friction reducing member may contain lubricating oil such as silicone oil.

The thermostat 46 functions as a safety device for the heating device 24. The thermostat 46 detects the temperature of the heat generating member 40. The thermostat 46 operates when the heat generating member 40 abnormally generates heat and the temperature rises to the cutoff threshold value. The operation of the thermostat 46 cuts off the current to the induced current generating unit 33. By cutting off the current to the induced current generating unit 33, it is possible to prevent the heating device 24 from abnormally generating heat.

The thermostat 46 is connected to a first end portion of the second biasing member 49. For example, the second biasing member 49 is an elastic member such as a compression spring. A second end portion of the second biasing member 49 is connected to the holder 47. The holder 47 is fixed to the frame 44. The thermostat 46 is pressed against the heat generating member 40 by the second biasing member 49. The thermostat 46 follows the swing of the heat generating member 40 by the pressing of the second biasing member 49. By following the swing of the heat generating member 40, the thermostat 46 is always in contact with the heat generating member 40.

The press roller 32 pressurizes the belt 30 by a pressurizing mechanism (not shown). For example, the press roller 32 includes a heat-resistant silicone sponge, a silicone rubber layer, or the like around the core metal. For example, a release layer is arranged on the surface of the press roller 32. The release layer is formed of a fluororesin such as PFA resin.

The belt 30 and the press roller 32 are driven by a drive unit (not shown) such as a motor. The press roller 32 is driven by the motor to rotate in the direction of arrow Q. If the belt 30 and the press roller 32 come into contact with each other, the belt 30 follows the press roller 32 and rotates in the direction of arrow R. If the belt 30 and the press roller 32 are separated from each other, the belt 30 is driven by the motor to rotate in the direction of the arrow R.

The virtual straight line that passes through the rotation center of the belt 30 and the rotation center of the press roller 32 when viewed from the belt axial direction is defined as a first straight line J. The virtual straight line that is orthogonal to the first straight line J and passes through the rotation center of the belt 30 when viewed from the belt axial direction is defined as a second straight line K. The heat generating member 40 is arranged closer to the induced current generating unit 33 than the second straight line K when viewed from the belt axial direction.

The induced current generating unit 33 is arranged outside the belt 30. The induced current generating unit 33 faces the belt 30. The induced current generating unit 33 faces the heat generating member 40 via the belt 30. The induced current generating unit 33 includes a coil (not shown). A high-frequency current is applied to the coil from an inverter drive circuit (not shown). By passing a high-frequency current through the coil, a high-frequency magnetic field is generated around the coil. The belt 30 is heated by the magnetic flux of the high-frequency magnetic field.

Due to the magnetic flux generated by the coil, a magnetic flux is generated between the heat generating member 40 and the belt 30. The belt 30 is heated by the magnetic flux generated between the heat generating member 40 and the belt 30. When the heat generating member 40 exceeds the Curie point, it changes from ferromagnetism to paramagnetism. When the heat generating member 40 exceeds the Curie point, the magnetic path passing between the heat generating member 40 and the heat generating layer is not formed and the heating of the belt 30 is not assisted. By forming the heat generating member 40 with a magnetic shunt alloy, it is possible to suppress an excessive temperature rise of the belt 30 at a high temperature while assisting the temperature rise of the belt 30 at a low temperature with the Curie point as a boundary.

Next, the heat generating member 40 will be described.

Figure 3:
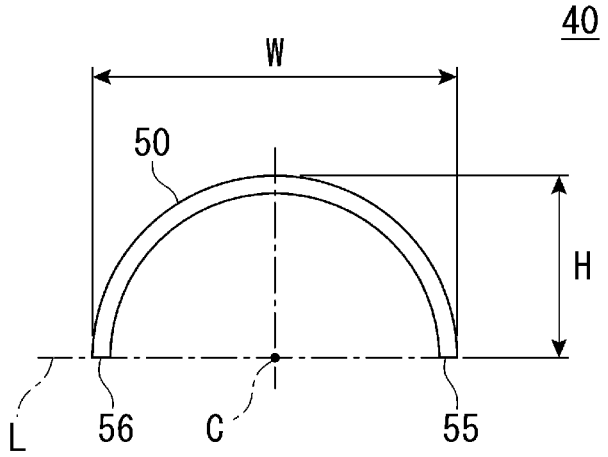
FIG. 3 is a schematic diagram of a heat generating member.

FIG. 3 is a schematic diagram of the heat generating member 40 according to the embodiment. In FIG. 3, the bent portions 51 and 52 and the like of the heat generating member 40 are not shown. As shown in FIG. 3, the heat generating member 40 includes the arc-shaped curved portion 50 when viewed from the belt axial direction. If the curved portion 50 has a semicircular shape when viewed from the belt axial direction, the arc center C of the curved portion 50 is arranged on the same plane including both end portions (the first end portion 55 and the second end portion 56) of the curved portion 50 in the circumferential direction.

The maximum width of both end portions of the curved portion 50 of the heat generating member 40 in the circumferential direction when viewed from the belt axial direction is defined as a width dimension W of the heat generating member. The maximum height of the curved portion 50 of the heat generating member 40 orthogonal to the width dimension W of the heat generating member when viewed from the belt axial direction is defined as a height dimension H of the heat generating member.

The virtual straight line passing through the arc center C of the curved portion 50 and both end portions (the first end portion 55 and the second end portion 56) of the curved portion 50 in the circumferential direction, when viewed from the belt axial direction, is defined as a third straight line L. As shown in FIG. 2, the third straight line L is arranged parallel to the second straight line K when viewed from the belt axial direction. The third straight line L is arranged closer to the induced current generating unit 33 than the second straight line K when viewed from the belt axial direction. The arc center C of the curved portion 50 is arranged on the first straight line J when viewed from the belt axial direction.

As described above, the magnetic flux generated from the coil of the induced current generating unit 33 generates heat in the heat generating layer of the belt 30, forms a magnetic path between the heat generating member 40 and the heat generating layer, and further causes the heat generating member 40 to self-heat. If there is heat transport between the heat generating member 40 and the belt 30, the temperature of the heat generating member 40 is maintained at a temperature about 20° C. higher than the temperature of the belt 30. Since the thermostat 46 is arranged in the sheet passing region in the belt axial direction, the detected temperature of the thermostat 46 is about 180° C. if the fixing temperature is 160° C.

However, the adhesion between the belt and the heat generating member is not sufficient, the heat transport between the heat generating member and the belt is not sufficiently performed, and the heat generating member may rise excessively. If the temperature of the heat generating member rises excessively, the detected temperature of the thermostat also rises excessively. That is, even though there is no abnormality in the temperature of the belt, the thermostat operates, that is, so-called premature cutting of the thermostat occurs.

Therefore, it is important that the belt and the heat generating member are sufficiently brought into close contact with each other in order to suppress an excessive temperature rise of the heat generating member. Here, the gap between the belt and the heat generating member is defined as an index showing the adhesion between the belt and the heat generating member. As a result of diligent research, the inventors of the present application found that the gap between the belt and the heat generating member correlates with the width dimension of the heat generating member.

FIG. 4 is a diagram showing the relationship between the width dimension of the heat generating member and the gap between the belt and the heat generating member according to the embodiment. In FIG. 4, the horizontal axis represents the width dimension [mm] of the heat generating member and the vertical axis represents the gap [mm] between the belt and the heat generating member. As shown in FIG. 4, it is recognized that the gap between the belt and the heat generating member becomes smaller as the width dimension of the heat generating member becomes larger.

By the way, if the heat generating member is formed in an arc shape along the inner peripheral surface of the belt, it is ideally preferable to measure the degree of contour of the heat generating member in order to control the dimensions of the heat generating member. However, the measurement of the degree of contour is extremely difficult in controlling the dimensions of the heat generating member in mass production.

Therefore, in the present application, mass production control of the dimensions of the heat generating member is possible by measuring the width dimension of the heat generating member. For example, if the heat generating member is molded by press working, the blank dimension (product dimension) corresponding to the die dimension of the press working is stable. Therefore, the dimensions of the heat generating member having an arc shape can be controlled in mass production by measuring the width dimension of the heat generating member (width dimension W of the heat generating member shown in FIG. 3).

As a result of diligent research, the inventors of the present application found that the temperature of the thermostat correlates with the width dimension of the heat generating member.

FIG. 5 is a diagram showing the relationship between the gap between the belt and the heat generating member and the temperature of the thermostat according to the embodiment. In FIG. 5, the horizontal axis represents the temperature [° C.] of the thermostat, and the vertical axis represents the gap [mm] between the belt and the heat generating member. As shown in FIG. 5, the temperature of the thermostat tends to increase as the gap between the belt and the heat generating member increases. As described above, there is a relationship that the gap between the belt and the heat generating member becomes smaller as the width dimension of the heat generating member becomes larger (see FIG. 4). In other words, it can be said that the temperature of the thermostat tends to increase as the width dimension of the heat generating member decreases.

By the way, there is a correlation between the inner diameter of the belt and the rigidity of the belt. Quantification of the rigidity of the belt is the amount of deflection of the belt. The low rigidity of the belt means that the belt is easily deformed by an external force. For example, if the heat generating member is pressed from the inside of the belt, the shape of the belt is easily deformed due to an external force for rotating the belt, an inertial force, a reaction force for sliding on the inner surface, and the like. That is, it is difficult for the belt to maintain a clean arc shape and it is also difficult to follow the arc shape of the heat generating member. As a result, since the shape of the belt during rotation is not stable, the adhesion between the belt and the heat generating member deteriorates, and the heat transport between the belt and the heat generating member also deteriorates.

FIG. 6 is a diagram showing the relationship between the difference between the inner diameter of the belt and the outer diameter of the heat generating member and the adhesion between the belt and the heat generating member according to the embodiment. Here, the inner diameter of the belt means the inner diameter of the belt if the belt has a perfectly cylindrical shape. The outer diameter of the heat generating member means the maximum width (width dimension of the heat generating member) of both end portions of the curved portion in the circumferential direction if the curved portion of the heat generating member has a semicircular shape.

The evaluation of the adhesion between the belt and the heat generating member is set as follows. The case where the temperature of the thermostat is lower than a target value (target value T shown in FIG. 7) even if the dimensions of the heat generating member vary (if mass production is possible) is defined as "O". When the temperature of the thermostat exceeds the target value depending on the variation in the dimensions of the heat generating member (when the temperature of the thermostat falls below the target value if the width dimension of the heat generating member is managed), it is set as "Δ". Although not shown, the case where the temperature of the thermostat exceeds the target value regardless of the variation in the dimensions of the heat generating member is defined as "x". For example, if a heat generating member having an outer diameter of 39.2 mm is set for a belt having an inner diameter of 40 mm, the adhesion is basically "x", but if the width dimension of the heat generating member is managed, the adhesion becomes "Δ".

As shown in FIG. 6, if the difference between the inner diameter of the belt and the outer diameter of the heat generating member is 0.6 mm or 0.7 mm, it is recognized that the evaluation of the adhesion between the belt and the heat generating member is O. On the other hand, if the difference between the inner diameter of the belt and the outer diameter of the heat generating member is 0.8 mm, it is recognized that the evaluation of the adhesion between the belt and the heat generating member is Δ.

Figure 7:
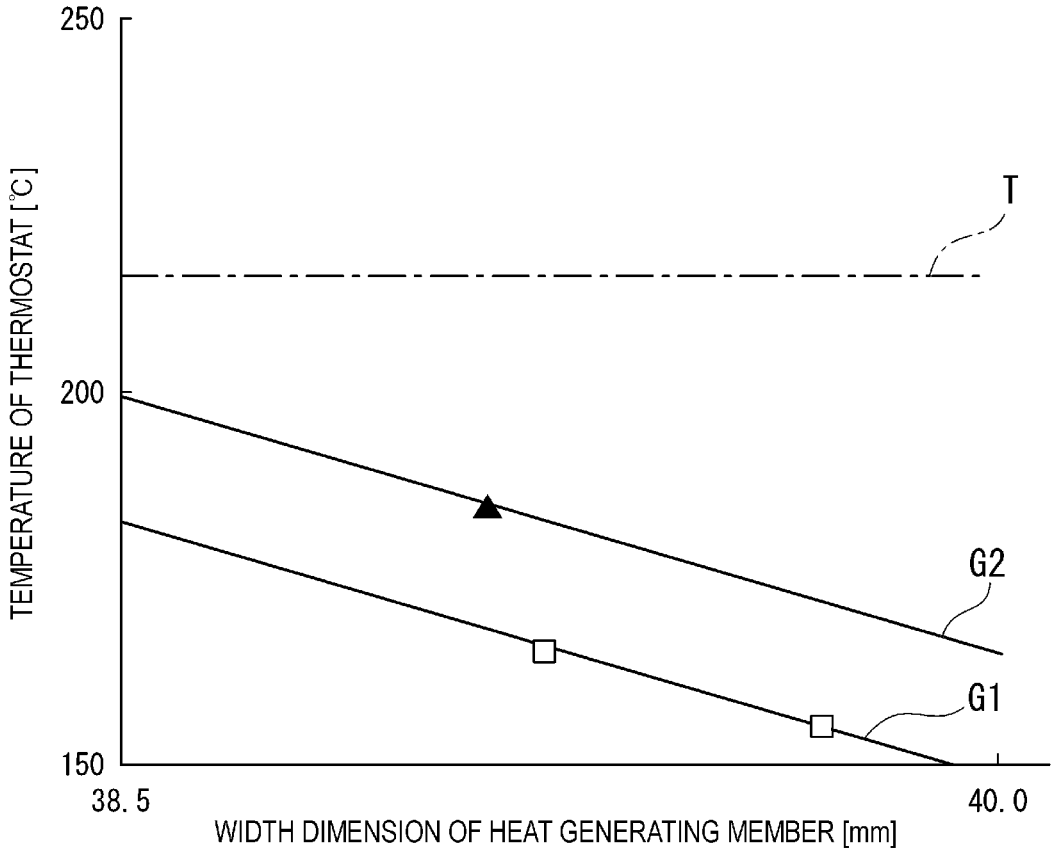
FIG. 7 is a diagram showing the relationship between the width dimension of the heat generating member and the temperature of the thermostat.

FIG. 7 is a diagram showing the relationship between the width dimension of the heat generating member and the temperature of the thermostat according to the embodiment. In FIG. 7, the horizontal axis represents the width dimension [mm] of the heat generating member, and the vertical axis represents the temperature [° C.] of the thermostat. In FIG. 7, a reference numeral G1 indicates a graph showing a relationship if a heat generating member having an outer diameter of 39.6 mm is set for a belt having an inner diameter of 40 mm, and a reference numeral G2 is a graph showing a relationship if a heat generating member having an outer diameter of 39.2 mm is set for a belt having an inner diameter of 40 mm, and a reference numeral T indicates the target value of the temperature of the thermostat, respectively.

As shown in FIG. 7, in both the graph G1 and the graph G2, it is recognized that the temperature of the thermostat tends to decrease as the width dimension of the heat generating member increases. It is recognized that the temperature of the thermostat tends to decrease by increasing the outer diameter of the heat generating member under the same condition in the inner diameter of the belt.

In FIG. 7, the graph G1 corresponds to the case where the difference between the inner diameter of the belt and the outer diameter of the heat generating member is 0.4 mm, and the graph G2 corresponds to the case where the difference between the inner diameter of the belt and the outer diameter of the heat generating member is 0.8 mm. In the case of the graph G1, the temperature of the thermostat is about 20° C. lower than that in the case of the graph G2, and the temperature of the thermostat is lower than the target value T even if the dimensions of the heat generating members vary. On the other hand, in the case of the graph G2, the temperature of the thermostat may exceed the target value T depending on the variation in the dimensions of the heat generating member, but if the width dimension of the heat generating member is managed, the temperature of the thermostat falls below the target value T. That is, if the difference between the inner diameter of the belt and the outer diameter of the heat generating member is 0.7 mm or less, the adhesion between the belt and the heat generating member is good (see FIG. 6), and the temperature of the thermostat is less likely to depend on the width dimension of the heat generating member (see FIG. 7).

The belt 30 and the heat generating member 40 of the embodiment satisfy the following equations (1) and (2).

$$D \geq 10 \text{ mm} \quad (1)$$

$$0.4 \text{ mm} \geq A-B \geq 0 \text{ mm} \quad (2)$$

Here, D is the amount of deflection of the belt, A is the radius of curvature of the inner peripheral surface of the belt, and B is the radius of curvature of the outer peripheral surface of the heat generating member. Specifically, the amount of deflection D of the belt means the amount of displacement of the end portion of the belt in the belt axial direction if a weight of 200 g is placed on the upper center of the belt axial direction with respect to a belt having a length of 100 mm in the belt axial direction. The radius of curvature A of the inner peripheral surface of the belt corresponds to a value of half the inner diameter of the belt. The radius of curvature B of the outer peripheral surface of the heat generating member corresponds to a value of half the outer diameter of the heat generating member.

The case where the amount of deflection D of the belt is 10 mm or more corresponds to the case where the inner diameter of the belt is 35 mm or more. The case where the difference (A−B) between the radius of curvature A of the inner peripheral surface of the belt and the radius of curvature B of the outer peripheral surface of the heat generating member is 0.4 mm corresponds to the case where the difference between the inner diameter of the belt and the outer diameter of the heat generating member is 0.8 mm (graph G2 shown in FIG. 7).

When changing the dimensions of the heat generating member 40, it is preferable to maintain the inscribed relationship with the inner peripheral surface of the belt 30. It is preferable that the arc center C of the curved portion 50 of the heat generating member 40 is arranged on the first straight line J when viewed from the belt axial direction at least within the range satisfying the above equation (2). That is, as the difference (A−B) between the radius of curvature A of the inner peripheral surface of the belt and the radius of curvature B of the outer peripheral surface of the heat generating member approaches 0 mm, the arc center C of the curved portion 50 shifts to the right side of the paper surface of FIG. 2 on the first straight line J and approaches the center (rotation center) of the belt 30. If the arc center C of the curved portion 50 of the heat generating member 40 is arranged on the first straight line J when viewed from the belt axial direction, the positional relationship with the induced current generating unit 33 is maintained, and thus, necessary heat is easily obtained.

It is preferable that the belt 30 and the heat generating member 40 of the embodiment further satisfy the following equation (3).

$$0.35 \text{ mm} \geq A-B \quad (3)$$

The case where the difference (A−B) between the radius of curvature A on the inner peripheral surface of the belt and the radius of curvature B on the outer peripheral surface of the heat generating member is 0.35 mm corresponds to the case where the difference between the inner diameter of the belt and the outer diameter of the heat generating member is 0.7 mm (see FIG. 6).

The belt 30 and the heat generating member 40 of the embodiment may further satisfy the following equations (4) and (5) instead of further satisfying the above equation (3).

$$0.4 \text{ mm} \geq A-B \geq 0.35 \text{ mm} \quad (4)$$

$$W > H \quad (5)$$

Here, W means the width dimension of the heat generating member and H means the height dimension of the heat generating member (See FIG. 3).

B in the above equation (4) is the theoretical value of the blank dimension of the sheet metal (mold dimension for press working). If the width dimension W of the heat generating member is larger than the height dimension H of the heat generating member, it corresponds to the semicircular arc shape shown in FIG. 3.

As described above, the heating device 24 of the embodiment includes the belt 30 and the heat generating member 40. The belt 30 has a tubular shape. The heat generating member 40 is provided inside the belt 30. The heat generating member 40 is formed in an arc shape along the inner peripheral surface of the belt 30. The heat generating member 40 is slidably in contact with the inner peripheral surface of the belt 30. When the amount of deflection of the belt 30 is D, the radius of curvature of the inner peripheral surface of the belt 30 is A, and the radius of curvature of the outer peripheral surface of the heat generating member 40 is B, the following equations (1) and (2) are satisfied.

$$D \geq 10 \text{ mm} \quad (1)$$

$$0.4 \text{ mm} \geq A-B \geq 0 \text{ mm} \quad (2)$$

With the above configuration, the following effects are achieved.

Even if the dimensions of the heat generating member 40 vary, the belt 30 and the heat generating member 40 can be sufficiently brought into close contact with each other, and the heat transport between the heat generating member 40 and the belt 30 can be sufficiently performed. Therefore, it is possible to suppress an excessive temperature rise of the heat generating member 40.

It is preferable that the heating device 24 further satisfies the following equation (3).

$$0.35 \text{ mm} \geq A-B \quad (3)$$

With the above configuration, the following effects are achieved.

The belt 30 and the heat generating member 40 can be brought into even closer contact with each other, and the heat transport between the heat generating member 40 and the belt 30 can be performed more effectively. Therefore, it is possible to more effectively suppress an excessive temperature rise of the heat generating member 40.

The heating device 24 may further satisfy the following equations (4) and (5) instead of further satisfying the above equation (3).

$$0.4\ \text{mm} \geq A-B \geq 0.35\ \text{mm} \quad (4)$$

$$W>H \quad (5)$$

With the above configuration, the following effects are achieved.

By managing the width dimension W of the heat generating member, even if the dimensions of the heat generating member 40 vary, the belt 30 and the heat generating member 40 can be sufficiently brought into close contact with each other, and heat transport between the heat generating member 40 and the belt 30 can be sufficiently performed. Therefore, it is possible to suppress an excessive temperature rise of the heat generating member 40.

The heating device 24 further includes the thermostat 46 that comes into contact with the inner peripheral surface of the heat generating member 40 and detects the temperature of the heat generating member 40, thereby achieving the following effects.

By suppressing the excessive temperature rise of the heat generating member 40, it is possible to prevent the thermostat 46 from being cut off prematurely. Therefore, the thermostat 46 can be stably operated as a safety device for the heating device 24.

Since the image processing device 1 is provided with the above-mentioned heating device 24, the following effects are achieved.

The heating device 24 can suppress an excessive temperature rise of the heat generating member 40. Therefore, the image processing device 1 can improve the image quality.

Next, a modification of the embodiment will be described.

The heating device of the embodiment satisfies the following equations (1) and (2).

$$D \geq 10\ \text{mm} \quad (1)$$

$$0.4\ \text{mm} \geq A-B \geq 0\ \text{mm} \quad (2)$$

On the other hand, the heating device may satisfy the following equation (6) instead of the above equation (2).

$$0.98 \leq B/A \leq 1$$

Here, B/A indicates the ratio of the radius of curvature B of the outer peripheral surface of the heat generating member to the radius of curvature A of the inner peripheral surface of the belt.

The curved portion of the heat generating member of the embodiment has a semicircular shape when viewed from the belt axial direction. On the other hand, the curved portion of the heat generating member may have an arc shape having a circumferential length smaller than that of the semicircular arc shape when viewed from the belt axial direction. Alternatively, the curved portion of the heat generating member may have an arc shape having a circumferential length larger than that of the semicircular arc shape when viewed from the belt axial direction. For example, the curved portion of the heat generating member only needs to be formed in an arc shape along the inner peripheral surface of the belt.

The image processing device of the embodiment is an image forming apparatus. On the other hand, the image processing device may be a decoloring device. If the image processing device is a decoloring device, the heating device performs a process of decoloring (erasing) the image formed on the sheet with the decolorable toner.

According to at least one embodiment described above, when the amount of deflection of the belt is D, the radius of curvature of the inner peripheral surface of the belt is A, and the radius of curvature of the outer peripheral surface of the heat generating member is B, the following equations (1) and (2) are satisfied.

$$D \geq 10\ \text{mm} \quad (1)$$

$$0.4\ \text{mm} \geq A-B \geq 0\ \text{mm} \quad (2)$$

With the above configuration, the following effects are achieved.

Even if the dimensions of the heat generating member vary, the belt and the heat generating member can be sufficiently brought into close contact with each other, and the heat transport between the heat generating member and the belt can be sufficiently performed. Therefore, it is possible to suppress an excessive temperature rise of the heat generating member.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

Example

Hereinafter, the present disclosure will be described in more detail with reference to Example, but the present disclosure is not limited to the following Examples.

Example

In the example, a cylindrical belt was used. The length of the belt in the belt axial direction was 100 mm. Two types of belts were used: a belt having an inner diameter of 30 mm and a belt having an inner diameter of 40 mm.

Experimental Example

The amount of deflection of the belt was measured for each of the belt having an inner diameter of 30 mm and the belt having an inner diameter of 40 mm in the example. A height gauge manufactured by Mitutoyo Co., Ltd. was used as a measuring instrument for the amount of deflection of the belt. The number of measurement samples for the amount of deflection of the belt was 6 for each inner diameter. The measuring position of the amount of deflection of the belt was set at both end portions in the belt axial direction (each of the upper left end portion Le of the belt and the upper right end portion Re of the belt shown in FIG. 8).

Figures 8, 9:
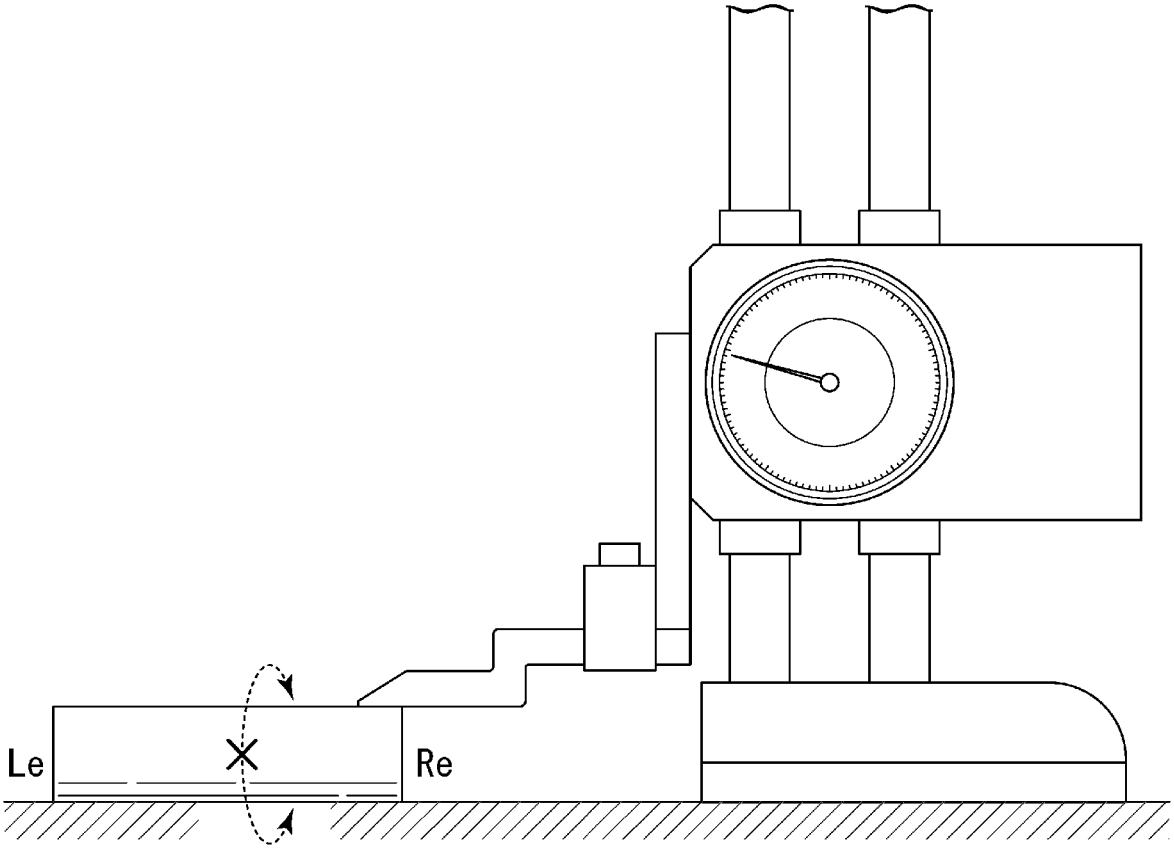
FIG. 8 is an explanatory diagram of a method for measuring the amount of deflection of the belt according to an example.
FIG. 9 is a diagram showing a measurement result of the amount of deflection of a belt having an inner diameter of 30 mm.

FIG. 8 is an explanatory diagram of a method for measuring the amount of deflection of the belt according to the example.

In the measuring method of the amount of deflection of the belt, the initial position of the belt (the position before deflection) is set to 0. Here, the initial position of the belt is the position before placing a weight of 200 g on the upper center in the belt axial direction with respect to the belt and means the light load position if the measuring unit of the height gauge is placed on the upper part of the end portion in the belt axial direction with respect to the belt to the extent that the belt does not move (to the extent that it does not rotate in the direction of the arrow in FIG. 8).

The amount of deflection of the belt was measured after placing a weight of 200 g on the upper center of the belt in the belt axial direction. The measuring position of the amount of deflection of the belt is the position after placing a weight of 200 g on the upper center of the belt axial direction with respect to the belt and is the light load position if the measuring unit of the height gauge was placed on the upper part of the end portion in the belt axial direction with respect to the belt to the extent that the belt does not move (to the extent that it does not rotate in the direction of the arrow in FIG. 8).

FIG. 9 is a diagram showing the measurement results of the amount of deflection of the belt having an inner diameter of 30 mm in the example.

As shown in FIG. 9, it was confirmed that the average value of the amount of deflection of the belt having an inner diameter of 30 mm was 6.2 mm.

FIG. 10 is a diagram showing the measurement results of the amount of deflection of the belt having an inner diameter of 40 mm in the example.

As shown in FIG. 10, it was confirmed that the average value of the amount of deflection of the belt having an inner diameter of 40 mm was 14.4 mm.

From the above, it was found that as the inner diameter of the belt increases, the amount of deflection of the belt increases (the rigidity of the belt decreases). Since the median value between the amount of deflection of the belt with an inner diameter of 30 mm and the amount of deflection of the belt with an inner diameter of 40 mm is about 10 mm, it was found that it can be estimated that the case where the amount of deflection of the belt is 10 mm or more corresponds to the case where the inner diameter of the belt is 35 mm or more.

What is claimed is:

1. A heating device, comprising:

a belt having a tubular shape; and a contact member provided inside the belt, the contact member having an arc shape along an inner peripheral surface of the belt and slidably in contact with the inner peripheral surface of the belt, wherein when an amount of deflection of the belt is D, a radius of curvature of the inner peripheral surface of the belt is A, and a radius of curvature of the outer peripheral surface of the contact member is B, equations (1) and (2) are satisfied:

$$D \geq 10 \text{ mm} \quad (1), \text{ and}$$

$$0.4 \text{ mm} \geq A-B \geq 0 \text{ mm} \quad (2).$$

2. The heating device according to claim 1, wherein equation (3) is further satisfied:

$$0.35 \text{ mm} \geq A-B \quad (3).$$

3. The heating device according to claim 1, wherein when a width of the contact member is W and a height of the contact member is H, equations (4) and (5) are satisfied:

$$0.4 \text{ mm} \geq A-B \geq 0.35 \text{ mm} \quad (4)$$

$$W>H \quad (5).$$

4. The heating device according to claim 1, further comprising:

a thermostat in contact with the inner peripheral surface of the contact member and configured to detect a temperature of the contact member.

5. The heating device according to claim 1, wherein the belt comprises a heat generating layer, a release layer, and a base layer.

6. The heating device according to claim 5, wherein the heat generating layer comprises a conductive metal and the base layer comprises a polymer.

7. The heating device according to claim 5, wherein the release layer comprises a fluoro-containing polymer.

8. The heating device according to claim 1, wherein the belt is an endless belt.

9. The heating device according to claim 1, wherein the contact member comprises a magnetic material.

10. The heating device according to claim 1, wherein a gap between the belt and the contact member correlates with a width of the contact member.

11. An image processing device, comprising an image reading component;

a display;

a sheet supply component;

an image forming component comprising a heating device comprising:

a belt having a tubular shape; and a contact member provided inside the belt, the contact member having an arc shape along an inner peripheral surface of the belt and slidably in contact with the inner peripheral surface of the belt, wherein when an amount of deflection of the belt is D, a radius of curvature of the inner peripheral surface of the belt is A, and a radius of curvature of the outer peripheral surface of the contact member is B, equations (1) and (2) are satisfied:

$$D \geq 10 \text{ mm} \quad (1), \text{ and}$$

$$0.4 \text{ mm} \geq A-B \geq 0 \text{ mm} \quad (2).$$

12. The image processing device according to claim 11, wherein equation (3) is further satisfied:

$$0.35 \text{ mm} \geq A-B \quad (3).$$

13. The image processing device according to claim 11, wherein when a width of the contact member is W and a height of the contact member is H, equations (4) and (5) are satisfied:

$$0.4 \text{ mm} \geq A-B \geq 0.35 \text{ mm} \quad (4)$$

$$W>H \quad (5).$$

14. The image processing device according to claim 11, further comprising:

a thermostat in contact with the inner peripheral surface of the contact member and configured to detect a temperature of the contact member.

15. The image processing device according to claim 11, wherein the belt comprises a heat generating layer, a release layer, and a base layer.

16. The image processing device according to claim 15, wherein the heat generating layer comprises a conductive metal and the base layer comprises a polymer.

17. The image processing device according to claim 15, wherein the release layer comprises a fluoro-containing polymer.

18. The image processing device according to claim 11, wherein the belt is an endless belt.

19. The image processing device according to claim 11, wherein the contact member comprises a magnetic material.

20. The image processing device according to claim 11, wherein a gap between the belt and the contact member correlates with a width of the contact member.

* * * * *